United States Patent [19]

Hoch et al.

[11] Patent Number: 4,979,684

[45] Date of Patent: Dec. 25, 1990

[54] DISPERSION, COMMINUTION OR DEAGGLOMERATION AND CLASSIFICATION OF SOLIDS

[75] Inventors: Helmut Hoch, Weisenheim; Reinhard Polke, Mutterstadt; Norbert Scholz, Hassloch, all of Fed. Rep. of Germany

[73] Assignee: BASF Aktiengesellschaft, Ludwigshafen, Fed. Rep. of Germany

[21] Appl. No.: 378,796

[22] Filed: Jul. 12, 1989

[30] Foreign Application Priority Data

Jul. 27, 1988 [DE] Fed. Rep. of Germany ..... 3825469

[51] Int. Cl.[5] ..... B02C 19/06

[52] U.S. Cl. ..... 241/39

[58] Field of Search ..... 241/5, 39, 79.1, 40, 241/100, 19

[56] References Cited

U.S. PATENT DOCUMENTS

| | | | |
|---|---|---|---|
| 3,462,086 | 8/1969 | Bertrand et al. | 241/39 X |
| 3,726,484 | 4/1973 | Schurr | 241/39 X |
| 3,951,347 | 4/1976 | Tiggesbaumker et al. | 241/79.1 X |
| 4,019,688 | 4/1977 | Akunov et al. | 241/39 |
| 4,602,743 | 7/1986 | Nied | 241/39 X |

*Primary Examiner*—Mark Rosenbaum

*Attorney, Agent, or Firm*—Keil & Weinkauf

[57] ABSTRACT

Solids are dispersed, comminuted or deagglomerated and classified in a single piece of equipment, a classifier jet mill representing a combination of a jet mill and a spiral flow classifier.

1 Claim, 1 Drawing Sheet

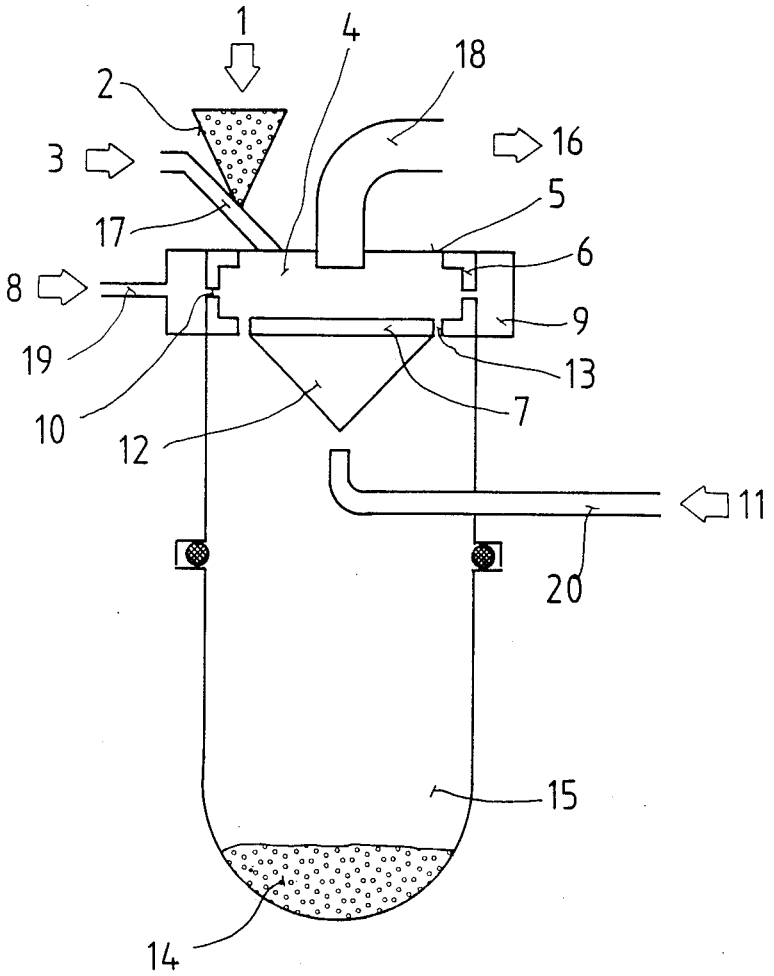
1
2
3
4
5
6
7
8
9
10
11
12
13
14
15
16
17
18
19
20

DISPERSION, COMMINUTION OR DEAGGLOMERATION AND CLASSIFICATION OF SOLIDS

BACKGROUND OF THE INVENTION

1. Field of the Invention

The present invention relates to a process for dispersing, comminuting or deagglomerating and classifying solids and to a classifier jet mill for carrying out these operations.

2. Description of the Prior Art

There are numerous known ways and machines for carrying out the abovementioned operations.

The choice of which process or equipment to use depends on various criteria, for example the particle size and nature of the solids.

Existing processes and apparatus are described in detail in the technical literature and makers' documentation.

For instance, in the text book by Vauck/Müller, Grundoperationen chemischer Verfahrenstechnik, 6th edition, the section on size reduction deals with:

(a) comminution of solids by means of a closed cycle (page 228), and (b) comminution of solids by means of ball mills, impact and centrifugal mills and jet mills (page 247 et seq.).

The same text book describes various spiral flow classifiers in the section on classifying (see page 297 et seq.).

Brochure 23/1d from Alpine AG, Augsburg, describes a classifier mill where the combined grinding and classification of the crude and end products is obtained by means of one machine unit.

However, the prior art processes and machines have various disadvantages, for example too much oversize and hence loss of material, damage to the readily dispersible portions of the product due to the high energy input required for comminution, or the need for the expensive inert gas procedure or similarly expensive pressure-resistant apparatus with explosive products.

SUMMARY OF THE INVENTION

It is an object of the present invention to meet the following technical and economic requirements in the field of the dispersion, comminution or deagglomeration and classification of solids:

1. selective comminution of the easily dispersible portions without product damage,
2. specific control of the length of time and the stress conditions under which the solids are resident in the dispersing space; that is, continuous and adjustable discharge of the difficult-to-disperse constituents or foreign substances from the dispersing space,
3. no rotating parts to avoid explosion hazards.

We have found that this object is achieved according to the invention by performing the operations described below using a piece of equipment (a classifier jet mill) which represents a combination of a jet mill and a spiral flow classifier.

BRIEF DESCRIPTION OF THE DRAWINGS

The classifier jet mill according to the invention is depicted in the drawing and is described hereinafter with respect to functioning and construction.

DESCRIPTION OF THE PREFERRED EMBODIMENT

The product supply 1 is effected through the product feed means 2 via injector gas 3 into the dispersing space 4, which is defined by lid 5, grinding ring 6 and base plate 7. The grinding gas 8, which also functions as sifting gas, is passed via a divider space 9 and nozzles 10 in the grinding ring into the dispersing space, where—depending on prepressure, gas rate and nozzle geometry—it has to control the specific stress imposed on the solids, the residence time and the separating limit. Residence time and separating limit can also be varied within wide limits by the supply of secondary gas 11, which is divided by the cone 12 and flows through the concentric slot 13. Coarse or difficult-to-disperse solids 14 leave the dispersing space through the slot and are deposited in the collecting vessel 15. Fine or easy-to-disperse solids 16 leave the dispersing space together with the exhaust air stream via the fines/exhaust air exit 18. Fines and exhaust air are separated in downstream, conventional separator units.

By means of the process according to the invention and the classifier jet mill according to the invention it is possible to effect specific control of the residence time of and the stress on the solids by supply of an adjustable secondary gas stream via the slot. The secondary gas stream alters the exit probability into the collecting vessel and shifts the separating limit within the dispersing space toward coarser values. Furthermore, a continuous removal of the coarse or difficult-to-disperse portions through the concentric slot of variable width into the collecting vessel is possible. For continuous operation, this collecting vessel can be replaced by a cone equipped with a suitable discharge element, for example an impeller wheel. This makes it possible to affect the comminution and separating effect within wide limits not only by variation of the grinding gas pressure, the grinding gas flow rate through the grinding ring and various nozzle geometries, from round to slot-like, but also by the supply of secondary gas at a certain rate.

It will be readily understood that the classifier jet mill according to the invention is not restricted to the above-described features and design but that it can be varied as regards technical and constructional details.

By means of the process according to the invention and the classifier jet mill according to the invention it is possible to obtain the advantages recited hereinafter:

- selective comminution,
- adjustable residence times and stress conditions of the solids,
- no buildup of difficult-to-comminute constituents and hence no non-steady-state conditions leading to worse degrees of fineness,
- high throughputs at low energy costs, since coarse material, dirt and difficult-to-disperse constituents need not be comminuted but are eliminated from the process,
- simple adjustment of the end product quality through variation of gas pressures, flow rates and geometries,
- no need for inertization or pressure-resistant construction in the case of explosive feed materials, since moving or rotating parts are absent,
- compact construction, which avoids conveying and intermediary separation, hence low investment and cleaning costs, simple measures in relation to machine linings for cohesive and abrasive feed materials, and inexpensive retrofitment of existing jet mills and spiral flow classifiers.

We claim:

1. A classifier jet mill comprising;

a dispersing space defined by a lid, a grinding ring equipped with nozzles, and a base plate, an injector tube for injector gas which ends in the lid and has associated product feed means, a tube for fines/exhaust air exit ending centrally in the lid, a divider space arranged around the dispersing space, for the division of grinding or sifting gas, a tube for grinding or sifting gas which ends in the divider space, a concentric slot in the base for coarse material output and secondary gas input, a collecting vessel for coarse material which adjoins the dispersing space, a cone attached underneath the base plate and projecting to the collecting vessel, and a tube for secondary gas which ends centrally below the cone.

* * * * *